United States Patent [19]

Danzik et al.

[11] 4,379,773

[45] Apr. 12, 1983

[54] PROCESS FOR WET SPINNING NYLON 4

[75] Inventors: Mitchell Danzik, Pinole, Calif.; J. Ronald Carpenter, Millersville, Md.

[73] Assignee: Chevron Research Company, San Francisco, Calif.

[21] Appl. No.: 156,457

[22] Filed: Jun. 4, 1980

[51] Int. Cl.[3] ..... D01F 6/00

[52] U.S. Cl. ..... 264/184; 264/203

[58] Field of Search ..... 264/184, 203; 260/29.2 N

[56] References Cited

U.S. PATENT DOCUMENTS

| | | | |
|---|---|---|---|
| 2,914,376 | 11/1959 | Bibolet et al. | 264/184 |
| 3,060,141 | 10/1962 | Black | 260/29.2 N |
| 3,269,970 | 8/1966 | Epstein et al. | 264/203 |
| 3,445,557 | 5/1969 | Horoldt | 264/210.3 |
| 3,492,390 | 1/1970 | Borner | 264/184 |
| 3,751,546 | 8/1973 | Horoldt | 264/184 |
| 4,073,837 | 2/1978 | Kouzai et al. | 264/184 |
| 4,185,063 | 1/1980 | Chute | 264/203 |

*Primary Examiner*—Jay H. Woo

*Attorney, Agent, or Firm*—D. A. Newell; T. G. De Jonghe; L. S. Squires

[57] ABSTRACT

Processes for wet spinning nylon 4 filaments. The processes are characterized by the use of a formic acid spinning dope and an acidic aqueous alkali metal formate coagulation bath maintained at elevated temperatures.

18 Claims, No Drawings

PROCESS FOR WET SPINNING NYLON 4

BACKGROUND OF THE INVENTION

THE INVENTION

This invention relates to improved methods of wet spinning nylon 4 (polypyrrolidone) and to the nylon 4 fibers thereby produced.

THE PRIOR ART

Generally, synthetic thermoplastic filaments are manufactured by one of three basic spinning procedures i.e., melt spinning, wet spinning, and dry spinning. Melt spinning is the least expensive of these procedures but can only with great difficulty be successfully applied to the commercial manufacture of nylon 4 because of the low thermal stability of nylon 4 which degrades around its melting point. Dry spinning is the most expensive of the three procedures because of the energy and recovery costs associated with the evaporation and recovery of solvent from the freshly spun material. Wet spinning also suffers costs disadvantages relative to melt spinning but is less expensive than dry spinning. One of the principal cost factors in wet spinning is the cost of recovering the solvent from the coagulation bath.

Wet spinning nylon 4 involves the extrusion of a solvent solution of nylon 4 (commonly referred to as a spinning dope) through a spinnerette, having a plurality of small orifices, into a coagulation bath. As the streams of nylon 4 pass through the spinnerette into the coagulation bath, the streams coagulate into filaments as the solvent diffuses into the bath. As the spinning operation continues, the concentration of the solvent builds up in the bath until the coagulation bath is no longer effective resulting in poorer quality filaments and an increased frequency of filament breaks occurring in the coagulation bath until the process must be shut down and the bath replenished.

One of the best solvents, recognized by the art, for wet spinning nylon 4, is formic acid. Unfortunately, we have found that in the usual wet spinning system, the coagulation bath will tolerate only a small build-up of formic acid before the quality of the filaments is impaired. This imposes an economic problem because the recovery of formic acid from the spent bath is made extremely expensive by the large amount of water which is present. This water cannot be removed by simple distillation procedures because of the low thermal stability of formic acid and the relative boiling points of formic acid and water (i.e., the water comes off before the formic acid).

Aqueous solutions of various salts and bases have been used as coagulation baths for nylon 4.

The solution to the most effective wet spinning system both from a filament quality viewpoint and process economic viewpoint is necessarily empirical in nature. This solution requires not one particular variable but rather the selection of a proper combination of variables, e.g., solvent, coagulation bath, coagulation temperature, etc., which cannot be predicted in advance.

U.S. Pat. No. 2,711,398 broadly teaches that anhydrous formic acid solutions containing at least 25% nylon 4 can be wet or dry spun, but only illustrates dry spinning. U.S. Pat. No. 3,060,141 similarly teaches that 10–50% aqueous formic acid containing 6 to 40% nylon 4, based on the anhydrous acid, can be wet spun and dry spun, but fails to illustrate either procedure. U.S. Pat. No. 2,980,641 discloses a solution of nylon 4 in aqueous phytic acid which is described as being wet spinnable, though no details of a wet spinning process are given.

U.S. Pat. No. 2,734,043 teaches diluting fiber-forming formic acid solutions of polypyrrolidone with aliphatic and chloroaliphatic acids. U.S. Pat. Nos. 3,003,984, 3,033,810 and 3,042,647 disclose wet spinning solutions of polypyrrolidone comprising phytic acid, trichlorinitropropanol, ferric chloride, and chlorinated phenol, respectively. U.S. Pat. Nos. 3,076,744 and 3,324,061 report the dry spinning of polypyrrolidone from aqueous solutions prepared from superheated water, 120°–180° C.

U.S. Pat. No. 3,445,557 discloses wet spinning solutions of beta-polyamides, in inorganic acids or organic acids, including formic acid, into aqueous solutions of certain salts, at bath temperatures of from 5° to 50° C., conveniently room temperature. U.S. Pat. No. 3,492,390, discloses wet spinning formic acid solutions of beta-polyamides into aqueous solutions of alkaline earth metal formates at temperatures of 23° C. and 27° C. U.S. Pat. No. 3,269,970, broadly discloses wet spinning sulfuric acid solutions containing a soluble salt and 5–30% of polyamide into aqueous formic acid or acetic acid at temperatures in the range of 0° to 100° C.

U.S. Pat. No. 4,094,945 broadly discloses spinning formic acid solutions of nylon 4 containing a volatile diluent (e.g., methylene chloride) at temperatures of about 20°–150° C., preferably 20°–40° C., and spinning such solutions into non-aqueous coagulation baths at 20°–150° C., preferably 25°–90° C.

U.S. Pat. No. 4,185,063, broadly states that solutions of nylon 4 in 80–97% hydrous formic acid containing 1.5 to 4 parts of hydrous formic acid per part of nylon 4 may be spun but wholly fails to teach how such spinning may be effected. Example 1 of this patent refers to wet spinning but is obviously directed to dry spinning since the example states that the procedure was carried out in air without the use of a coagulation bath. Japanese Pat. No. 36-5165 discloses solution spinning nylon 4 using a zinc chloride solution.

SUMMARY OF THE INVENTION

The present invention provides a more economic wet spinning process for producing nylon 4 filaments.

In wet spinning nylon 4, it was found that spinning a formic acid solution of nylon 4 into an aqueous alkali metal formate coagulation bath at room temperature produced good quality nylon 4 filaments. However, it was further found that the coagulation bath could only tolerate a formic acid build-up to about 6–7 wt %, before the spinning process and quality of the filaments deteriorated (increased breaks occurring in the coagulation bath and poorer tensile strength). We have now unexpectedly discovered that by increasing the temperature of the alkali metal formate coagulation bath, a formic acid build-up to about 30 wt % can be tolerated without significantly impairing spinnability and fiber quality. Further, because of the higher formic acid concentration in the spent bath the recovery of formic acid from the spent coagulation bath is substantially less costly. Unexpectedly, the present invention also improves spinnability, permitting faster spinning rates to be used.

The wet spinning process of the present invention comprises extrusion spinning a 60–100%, typically 60–95% aqueous formic acid solution of nylon 4 into an aqueous alkali metal formate coagulation bath containing up to 30% by weight formic acid and maintained at temperatures in the range of about 35 up to its boiling point, thereby forming nylon 4 filaments.

FURTHER DESCRIPTION OF THE INVENTION AND PREFERRED EMBODIMENTS

Considering the invention in greater detail, the present wet spinning process uses a spinning dope comprising, as the solvent, 60 to 100 wt %, typically 60–95 wt % and preferably 70–85 wt %, aqueous formic acid (i.e. formic acid containing 40 to 0% water) as the solvent. The spinning dope typically has a nylon 4, or polymer, content of about from 10 to 40%, preferably about from 15 to 25%, by weight based on the weight of the anhydrous or aqueous formic acid spinning dope solvent i.e., about from 0.1 to 0.4 parts, preferably 0.15 to 0.4 parts of nylon 4 per part of solvent. Generally, anhydrous formic acid is not preferred because of cost consideration involved in the separation of water from formic acid. Thus, as above noted, the formic acid spinning dope solvent will contain 60–95% formic acid and 40 to 5% water.

Generally, the present process can be applied to wet spin any nylon 4 polymer capable of forming fibers. Nylon 4 is, of course, a known material and can be prepared by any suitable process which yields a fiber forming polymer. One suitable procedure is, for example, described in U.S. Pat. No. 3,721,652. Typically, the nylon 4 used in the present invention has a weight average molecular weight of about from 20,000 to 500,000, preferably about from 80,000 to 120,000. Generally, best results in terms of filament strength and spinnability are obtained by using nylon 4 having a weight average molecular weight of about from 80,000 to 120,000 and a spinning dope having polymer concentration of about from 0.15 to 0.35 parts of polymer per part of solvent. If higher molecular weight polymers and/or high polymer concentrations are used, the viscosity of spinning dope increases and adjustments must be made in the spinning process to compensate for the high viscosities. If lower molecular weight polymers are used, filament properties such as tensile strength tend to be poorer. If spinning dopes having lower polymer concentrations are used, the dope viscosity is decreased and generally poorer weight quantity production rate economics results.

In the present invention an aqueous solution of an alkali metal formate salt, or mixtures of such salts, is used as the coagulation bath. Generally, because of cost considerations, either sodium formate or potassium formate will be used. Best results are typically obtained using potassium formate. Typically, the coagulation bath, discounting the formic acid, contains about from 40 to 70 wt % alkali metal formate; 30 to 60 % water. The coagulation bath can also contain up to about 30 wt % formic acid, preferably less than about 25 wt %. The primary advantage afforded by the present invention is afforded where the coagulation bath contains about 6 to 30 wt % formic acid.

Where a batch or semi-batch coagulation bath system is used, the concentration of formic acid in the bath will increase during the spinning operation as formic acid from the spun dope diffuses into the bath. Initially, in a batch or semi-batch system, the initial coagulation bath will not contain formic acid or will only contain such formic acids as cost economics do not justify the reclamation from the spent bath operation. Thus, typically, the initial coagulation bath will contain less than 10 wt %, and preferably less than 5% formic acid. In a batch or semi-batch system when the concentration of formic acid in the bath builds up to about from 20 to 30%, preferably about from 20–25 wt %, formic acid, the spent bath is removed for reclamation and fresh coagulation bath solution used.

In most instances, the coagulation bath will be operated as a continuous system wherein the formic acid concentration will be maintained substantially constant by continuously withdrawing a portion of the bath and continuously adding fresh aqueous alkali metal formate solution, containing no formic acid or only a small amount of formic acid, thereto.

In order to facilitate economic formic acid recovery, it is preferred to operate the coagulation batch at the highest formic acid concentration tolerated by the filament coagulation operation which does not significantly affect the quality of the filament product (e.g., tensile strength). Generally, we have found that a preferred balance between spinnability economics and filament quality and formic acid recovery economics is obtained by using formic acid concentrations in the coagulation bath of about 15 to 25 wt %. This concentration lends itself to good formic acid recovery costs while maintaining high filament quality and good filament coagulation.

The reason that the present process is able to successfully operate at such high formic acid concentration in the coagulation bath is because of the higher coagulating bath temperatures used by the present invention. In the present invention, the coagulation bath is operated at temperatures in the range of about from 35° C. up to the boiling point of the coagulation bath and preferably about from 35°–60° C. Generally, best results are obtained using temperatures in the range of about from 40° to 55° C. In contrast to this, when we attempted to conduct the same spinning process using a room temperature (20°–25° C.) coagulation bath having a formic acid concentration above 6–7 wt %, we experienced so many filament breaks that the process could no longer be conducted effectively. Thus, as before noted, the present invention affords its primary advantage over such systems at formic acid bath concentrations above about 6 or 7 wt % formic acid or in other words operating at formic acid bath concentrations of about 6 to 30 wt % and preferably about from 15 to 25 wt %.

Generally, we have found that best results are obtained by operating the coagulation bath as a continuous bath using a set point formic acid concentration of about 20 wt % and coagulation bath temperature above about 40° C. up to 55° C. As before mentioned, the acid concentration is maintained constant in the bath by continuously withdrawing a portion of the bath and replenishing the bath with make-up bath solution having a lower formic acid concentration.

In both the batch, semi-batch and continuous system, a residence time of the initial filament or spun dope, within the coagulation bath, of about from 5 to 20 seconds is typically used.

For purposes of illustration, an in-line wet spinning, drawing, and heat-setting process, using the present wet spinning system, will be briefly described. In accordance with the practice of the present invention, the above described spinning dope is spun (extruded) through a multi-orifice spinnerette, generally having orifice diameters in the range of about from 20 to 300 microns, preferably 80 microns or larger into the aforedescribed coagulation bath at the above prescribed temperature. Usually, the spinnerette head and spinnerette is immersed in the coagulation bath and thus the temperature of the spinning dope as it passes through the spinnerette orifice into the bath will be about the same as the coagulation bath. As the steams of spinning dope formed by the spinnerette orifices enter into and pass through the coagulation bath, these streams coagulate into filaments. The filaments are collected from the coagulation bath generally at speeds at least equal to the speed (velocity) of the dope through the spinnerette orifice. The filaments are then washed, for example, via passage through a water bath and then drawn, usually at final draw ratios of about 2–6, preferably about 4–5. The drawn filament are then heat set, for example, by passage over one or more hot rolls at temperatures below the melting point of the filament. The filaments are then collected onto rolls. Typically, a finish is applied before heat setting to assist in subsequent operations as a lubricant. The washing, finish application drawing, heat setting, and filament winding operations can be effected by any suitable procedure. The details of such procedures are well known to the art and do not form part of the present invention.

The formic acid can also be recovered from the spent coagulation bath by any suitable procedure, such as, for example, are known to the art and the details of such procedures also do not form part of the present invention. One suitable procedure which can be used is, for example, described by Byron Anshus in commonly assigned copending application, U.S. Ser. No. 124,936, filed Mar. 4, 1980 now abandoned, the description of which procedure is hereby incorporated by reference.

DEFINITIONS

As used herein, the following terms have the following meanings unless expressly stated to the contrary.

The term "weight average molecular weight" refers to the value determined from the viscosity of the polymer in formic acid. More specifically, this is determined by a viscosity method using a 1 g sample of the polymer to be tested in 10 cc of 88 wt % formic acid and comparing the viscosity of the so dissolved sample with specific viscosity of 0.1 g of reference polymers in 100 ml of m-cresol (see Molecular Weight, Tuzer et al, Coll. Czech. Comm. 39 220C (1974)).

The term "final draw" refers to the ratio of the linear speed at which the filament (or filament bundle) is ultimately collected, from the in-line process divided by the speed at which the filament is collected from the coagulation bath.

The term "percent or %" refers to weight percent.

The term "parts" refers to parts by weight.

A further understanding of the invention can be had from the following nonlimiting Preparations and Examples.

PREPARATION A

For comparison purposes, this preparation illustrates a nylon 4 wet spinning process wherein the coagulation bath is operated at room temperature (i.e. 23° C.) up to the maximum coagulation bath formic acid concentration tolerated by such process.

In this preparation a nylon 4 spinning dope consisting of 1 part of nylon 4 (weight average molecular wt about 100,000) per 4 parts of 85 wt % aqueous formic acid was spun into a coagulation bath initially consisting of about 52.5% potassium formate; about 3.8% formic acid (determined by titration) and the remainder water. The coagulation bath was prepared by adding 300 g of 88 wt % formic acid to 6300 g of 55% aqueous potassium formate. Percent formic acid was determined by titration of a sample of the bath with a standard aqueous sodium hydroxide solution.

After successful operation at a given acid concentration, the acid concentration of the coagulation bath was periodically adjusted by the addition of a small amount of formic acid to hasten acid build-up. The acid concentration was in each case determined by titration as before. The temperature of the coagulation bath was maintained throughout at 23° C. The filament take-up from the bath was constant at about 13 feet/min.

After coagulation, the filaments were drawn (final draw ratio about 4-5:1) and washed, and examined for general condition and broken filaments.

The results of this Preparation are summarized in the following table.

TABLE A

| Coagulation Bath | | |
|---|---|---|
| Temperature °C. | Acid Wt % | Condition of Filament |
| 23 | 3.8 | Good |
| 23 | 4.2 | Generally good with a few breaks occurring in coagulation bath. |
| 23 | 6.1 | Still good but frequency of breaks in coagulation bath increasing. |
| 23 | 6.5 | Frequency of breaks in coagulation bath increasing, operation discontinued. |

As can be seen from the above table as the concentration of formic acid increased, the frequency of breaks in the coagulation bath increased. At a 6.5 wt % formic acid concentration, the frequency of filament breaks occurring in the coagulation bath had reached the limit tolerated for continued operation at reasonable efficiency.

EXAMPLE 1

This example illustrates the process of the present invention and its advantages over the process of Preparation A hereinabove.

In this example, the wet spinning process of Preparation A was continued but using the conditions of the present invention. Initially, the formic acid concentration of the coagulation bath in Preparation A was reduced from 6.5 wt % to 4.1 % via neutralization with 50% aqueous potassium hydroxide. Wet spinning trials were then conducted at various coagulation bath formic acid concentrations and temperatures, and the condition of the filaments in the coagulation bath observed and noted as in Preparation A. The results of these trials are summarized in the following Table I.

TABLE B

| COAGULATION BATH | | |
|---|---|---|
| Temperature °C. | Formic Acid Wt % | FILAMENT Condition and Spinnability |
| 35–36 | 4.8 | No filament breaks. Process running very well. |
| 39 | 6.0 | No broken filaments. Process running very smoothly. |
| 39.5 | 7.4 | No broken filaments. Process running well. |
| 39.5 | 11.1 | No broken filaments. Process running well. |
| 42 | 12.9 | No broken filaments. Process |

TABLE B-continued

| COAGULATION BATH | | |
|---|---|---|
| Temperature °C. | Formic Acid Wt % | FILAMENT Condition and Spinnability |
| | | running well. |
| 44 | 15.7 | No broken filaments. Process running well. |
| 44 | 19.2 | No broken filaments. Process running well. |

As can be seen by comparing the results set forth above with those set forth in Table A of Preparation A, much higher formic acid concentrations can be employed by operating the coagulation bath at higher temperatures, in accordance with the present invention, without producing filament breaks or adversely affecting the wet-spinning-coagulation process. Further, it was found that in the 40°-45° C. coagulation bath temperature range, a pronounced improvement in spinnability was obtained which permitted the use of a winder take-up speed as high as 113 ft/min.

EXAMPLE 2

This example further illustrates the wet spinning process of the present invention.

In this example, a spinning dope containing 1 part of a nylon 4 polymer (having a weight average M.W. of 100,000) per 4 parts of 85 wt % aqueous formic acid was spun into a coagulation bath containing 10.1 wt % formic acid (determined by titration). The coagulation bath was prepared by adding 800 g of 88 wt % aqueous formic acid to 6300 g of an aqueous potassium formate solution containing 55 wt % potassium formate and 45 wt % water. The same spinning equipment was used as was used in Preparation A and Example 1 and as before, coagulation bath acidity was determined by titration of a small sample of the bath with a standardized sodium hydroxide solution. Also, unless otherwise indicated a dope spinning rate of 2.14 cc/min and a total draw ratio of 2:1 was used.

Periodically the temperature and/or acidity were varied to determine their effect on filament coagulation and spinnability. The results of these tests are summarized in the following table.

TABLE C

| COAGULATION BATH | | |
|---|---|---|
| Temperature °C. | Formic Acid Wt % | FILAMENT Condition and Spinnability |
| 35 | 10.1 | No broken filaments. Spinning well. |
| 38 | 10.1 | No broken filaments. Spinning well. |
| 41 | 11.9 | No broken filaments. Spinning well. |
| 41 | 15.1 | No broken filaments. Spinning well. |
| 41 | 18 | No broken filaments. Spinning well. |
| 41 | 20 | No broken filaments. Spinning well. |
| 42 | 22.8 | No broken filaments. Spinning well. |
| 44 | 24.8* | No broken filaments. Spinning well. |
| 44 | ~27 | No broken filaments in bath, but some breaks now occurring at draw roll. Cannot draw without breaking above 3.9:1 (total draw ratio). |

*Total draw ratio 3.9/1

As can be seen from the above results, the present invention affords good filaments and spinnability up to formic acid concentration of about 25% in the coagulation bath. At formic acid concentrations of 27%, no filament breaks occurred in the coagulation bath but the filaments had poorer drawabilities, thus necessitating the use of lower draw ratios and corresponding the production of slightly poorer quality filaments.

Obviously, many modifications and variations of the invention, described hereinabove and below in the claims, can be made without departing from the essence and scope thereof.

What is claimed is:

1. A wet spinning process, for wet spinning nylon 4 filaments, which comprises the steps of:

(a) extrusion wet spinning a spinnable solution of nylon 4 dissolved in a solvent containing about from 60 to 100 wt % formic acid and about from 40 to 0 wt % water into an acidic aqueous coagulation bath containing a nylon 4 coagulation effective amount of alkali metal formate selected from the group consisting of sodium formate, potassium formate, lithium formate and mixtures thereof, and about from 6 to 30 wt %, formic acid, for a sufficient time to coagulate said spun nylon 4 solution into filaments and wherein said coagulation bath is maintained at temperatures in the range of about from 35° C. up to the boiling point of said coagulation bath; and (b) collecting said filaments.

2. The process of claim 1 wherein said coagulation bath contains about from 40 to 70 wt % of said alkali metal formate salt.

3. The process of claim 2 wherein said alkali metal formate salt is selected from the group consisting of potassium formate, sodium formate, and mixtures thereof.

4. The process of claim 1 wherein said solvent contains about from 60 to 95 wt % of said formic acid and about from 40 to 5 wt % of said water.

5. The process of claim 4 wherein said coagulation bath contains about from 20 to 25 wt % of said formic acid.

6. The process of claim 1 wherein said coagulation bath is maintained at temperatures in the range of about from 35° to 60° C.

7. The process of claim 6 wherein said coagulation bath is maintained at temperatures in the range of about from 40° to 55° C.

8. The process of claim 1 wherein said spinning dope contains about from 0.1 to 0.4 parts of said nylon 4 per part of said aqueous formic acid.

9. The process of claim 8 wherein said spinning dope contains about from 0.15 to 0.35 parts of said nylon 4 per part of said aqueous formic acid.

10. The process of claim 9 wherein said coagulation bath is maintained at temperatures in the range of about from 35° to 60° C. and contains about from 40 to 55% weight of an alkali metal formate selected from the group consisting of potassium formate, sodium formate, and mixtures thereof and about from 6 wt % up to about 25 wt % formic acid.

11. The process of claim 10 wherein said alkali metal formate is potassium formate.

12. The process of claims 1-3, 5-9, or 11 wherein said coagulation bath is operated as a continuous bath wherein said bath is maintained at a formic acid concentration in the range of 15 to 25 wt % by continuously removing a portion of said bath and continuously replenishing said bath with make-up aqueous alkali metal formate solution containing from 40 to 55 wt % alkali metal formate and about from 0 to 10 wt % formic acid.

13. A wet spinning process comprising the steps of:

(a) spinning a spinning dope, consisting essentially of a 60 to 85 weight percent aqueous formic acid solution of a fiber forming nylon 4 polymer, into a 40 to 70 weight percent aqueous alkali metal formate coagulation bath having a formic acid concentration in the range of about from 6 to 30 weight percent and maintained at about from 35° C. up to the boiling point of said coagulation bath, whereby filaments of said nylon 4 coagulate and formic acid diffuses into said bath from the spun dope;

(b) removing at least a portion of said bath when its formic acid concentration is in the range of about from 20 to 30 wt %;

(c) regenerating the removed portion of said bath by removing the major portion of said formic acid therefrom and recycling the regenerated bath back to said coagulation bath.

14. The process of claim 13 wherein said removed portion of said bath is a minor portion and is continuously removed from said coagulation bath and wherein said bath is continuously replenished with a 40 to 55% aqueous alkali metal formate solution having a formic acid concentration less than about 10 wt %.

15. The process of claim 13 wherein the replenishing solution contains less than about 5 wt % formic acid.

16. The process of claims 13, or 14 wherein said spinning dope contains about from 10 to 40 wt %, based on the weight of said aqueous formic acid, of said nylon 4.

17. The process of claim 13 wherein said coagulation bath is maintained at temperatures in the range of about from 40°-55° C.

18. The process of claim 14 wherein said coagulation bath is maintained at temperatures in the range of about from 40°-55° C. and is maintained at a set point formic acid concentration of about 20 weight percent.

* * * * *

UNITED STATES PATENT AND TRADEMARK OFFICE

CERTIFICATE OF CORRECTION

PATENT NO. : 4,379,773

DATED : April 12, 1983

INVENTOR(S) : DANZIK ET AL

It is certified that error appears in the above-identified patent and that said Letters Patent are hereby corrected as shown below:

Column 10, line 11 - "The process of claims 13, or 14 wherein" should read -- The process of claims 13, 14, 17 or 18 wherein --.

Signed and Sealed this

*Thirtieth* Day of *August 1983*

[SEAL]

*Attest:*

GERALD J. MOSSINGHOFF

*Attesting Officer*

*Commissioner of Patents and Trademarks*